US008668398B2

(12) United States Patent
Rosengard

(10) Patent No.: US 8,668,398 B2
(45) Date of Patent: Mar. 11, 2014

(54) HAIR COLORATION APPLICATOR

(76) Inventor: Andrea Rosengard, New York, NY (US)

( * ) Notice: Subject to any disclaimer, the term of this patent is extended or adjusted under 35 U.S.C. 154(b) by 752 days.

(21) Appl. No.: 12/412,180

(22) Filed: Mar. 26, 2009

(65) Prior Publication Data

US 2009/0245917 A1 Oct. 1, 2009

Related U.S. Application Data

(60) Provisional application No. 61/039,452, filed on Mar. 26, 2008.

(51) Int. Cl.
*B43K 27/04* (2006.01)

(52) U.S. Cl.
USPC ..... 401/34; 401/17; 401/19

(58) Field of Classification Search
USPC ..... 401/17, 19, 23, 34, 35, 24
See application file for complete search history.

(56) References Cited

U.S. PATENT DOCUMENTS

| | | | | | |
|---|---|---|---|---|---|
| 2,628,624 | A * | 2/1953 | De Mario | 401/31 |
| 2,636,598 | A * | 4/1953 | Hopgood | 401/30 |
| 2,710,614 | A * | 6/1955 | Dulberg | 132/318 |
| 2,721,561 | A * | 10/1955 | Dyche | 401/129 |
| 3,102,742 | A * | 9/1963 | Shurcliff | 403/63 |
| 3,828,802 | A * | 8/1974 | Spanel | 401/19 |
| 3,887,287 | A * | 6/1975 | Rosh, Jr. | 401/35 |
| 5,895,160 | A * | 4/1999 | Ginelli | 401/17 |
| 6,106,917 | A * | 8/2000 | Pereira et al. | 428/42.3 |
| 6,149,330 | A * | 11/2000 | Chuang | 401/34 |
| 6,345,922 | B2 * | 2/2002 | Tani | 401/32 |
| 6,491,464 | B1 * | 12/2002 | Young | 401/35 |
| 6,663,305 | B2 * | 12/2003 | Poulos | 401/19 |
| 6,695,510 | B1 * | 2/2004 | Look et al. | 401/68 |
| 7,021,849 | B2 * | 4/2006 | Ramet | 401/176 |
| 7,077,591 | B2 * | 7/2006 | Gueret | 401/17 |
| 7,252,091 | B1 * | 8/2007 | Wayne et al. | 132/112 |
| 7,255,508 | B1 * | 8/2007 | Knight | 401/35 |
| 7,648,295 | B2 * | 1/2010 | Fredell | 401/25 |
| 2003/0172469 | A1 * | 9/2003 | Schulze zur Wiesche et al. | 8/405 |

* cited by examiner

*Primary Examiner* — David J. Walczak
*Assistant Examiner* — Jennifer C Chiang
(74) *Attorney, Agent, or Firm* — Lucas & Mercanti, LLP

(57) ABSTRACT

This invention disclosed hair coloration applicator designed with a holder with two ends, at least one opening provided on each of said ends corresponding with the opening on the other end, at least one pair of coloration bars being fixed at said corresponding openings on said two ends, in which said coloration bars are made of coloring compound with a color in a specific hair color family and can be blended together to make a variety of hair color shades. The Invention allows a person to blend the right color within their hair color range since it has colors that blend together to create a variety of shades within a specific color scheme.

9 Claims, 2 Drawing Sheets

A

B

C

Example Dimensions of Fig. 2

SIZES

SHAPES

VARIOUS COLORS IN APPLICATOR

HAIR COLORATION APPLICATOR

CROSS REFERENCES TO RELATED APPLICATION

This Application claims the priority of U.S. Provisional Application No. 61/039,452 filed Mar. 26, 2008, the contents of which are incorporated by reference.

TECHNICAL FIELD

The invention relates to a hair color applicator that holds two or more hair color compounds.

BACKGROUND OF THE INVENTION

As people live longer due to the advancements in medicine, aging is still a fact of life and the desire to keep a youthful appearance is a constant problem for most people. The invention enables a person who strives for a youthful look the ability to achieve it when it comes to the color of their hair.

Today there are a multitude of products that allow a person to permanently or semi-permanently color their hair. There are hair dyes that are marketed that most any non-professional can use by reading simple directions that enable them to apply the dye to the hair. There are those dyes that need a professional hairdresser to blend and apply it to the scalp. Also there are those dyes that can be sprayed on. Most types of hair dyes come in a variety of colors. In addition there are hair color sticks that are on the market that come in one color shade that can be applied to the gray or white hair like color lipstick that is applied to the lips, those dye sticks that have to be wet that are rubbed on to the hair to be effective, those that do not have to be wet to be applied and those that are liquid and are brushed on like color mascara is to color eye lashes.

The invention addresses the problem many men and women face when aging or when they show signs of prematurely aging by their hair turning gray or white. The invention solves this problem without dying their hair. It provides an easy tool to cover the signs of aging by allowing a person to simply and easily rub on color that will hide the gray or white hair anytime or any place.

SUMMARY OF THE INVENTION

This invention disclosed hair coloration applicator designed with a holder with two ends, at least one opening provided on each of said ends corresponding with the opening on the other end, at least one pair of coloration bars being fixed at said corresponding openings on said two ends, in which said coloration bars are made of coloring compound with a color in a specific hair color family and can be blended together to make a variety of hair color shades.

The holder of the hair coloration applicator can be cylindrical, a regular polyhedron or of a irregular shape. The hair coloration applicator can have multiple openings are provided on each of the ends with multiple pair of coloration bars fixed in the openings corresponding to each other. The hair coloration applicator may have coloration bars made of coloring compound with the color in a hair color family chose from black-dark brown, dark grown-middle brown, auburn-middle brown or light blonde brown-middle brown.

DESCRIPTION OF DRAWINGS

FIG. 1A: the dimension of one embodiment

FIG. 1B: the design of several single spectrum hair color pens

FIG. 1C: Color blending spectra of single spectrum hair color pens

DETAILED DESCRIPTION OF THE INVENTION

The invention can be made with two or more colors that can blend together within a color range and also can be in various sizes applicators. The compound characteristics are that it glides onto the hair and scalp easily with or without the need to wet it with water.

Figure 1:
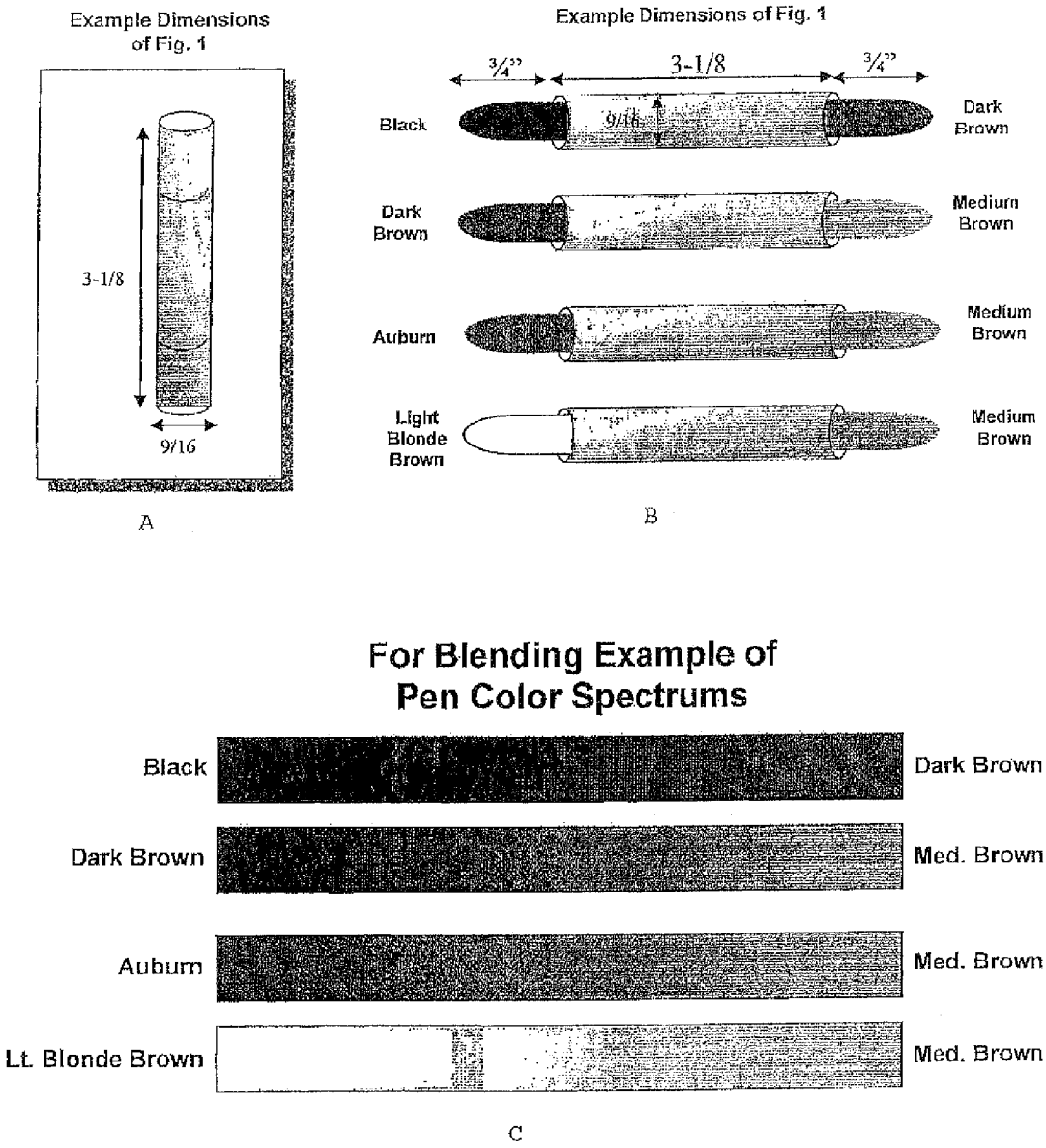
FIG. 1: Single spectrum hair color-applicator series

FIG. 1 is one embodiment of the invention—single spectrum hair color applicator series.

As shown in FIG. 1A, the applicator can be in the dimension of 3⅛ by 9/16 inches. In FIG. 1 the example of the inventions applicator is 3 and ⅜ inches in length and 9/16 inches wide. The color compound is % inches long and % inch wide.

In this embodiment, the color pens are in four different color families that being (1) black-dark brown, (2) dark brown-medium brown, (3) auburn-medium brown and (4) ash blond-medium brown. The user can apply each color individually as well as create a variety of colors by blending the colors together when applying to the gray and or white hair.

The applications of different color shades are shown in the FIG. 1C: Color blending spectra of single spectrum hair color pens. The various colors in the invention and the color schemes used can be varied based on the colors that are in fashion. The Invention allows a person to blend the right color within their hair color range since it has colors that blend together to create a variety of shades within a specific color scheme.

Figure 2:
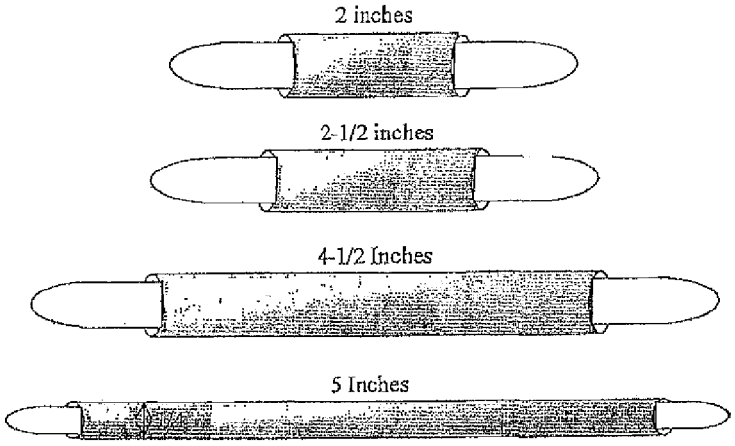
FIG. 2: Size varieties of single spectrum hair color pen
Figure 3:
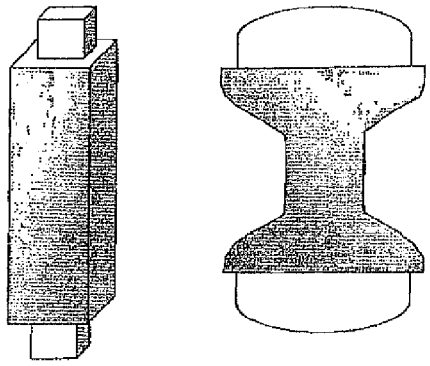
FIG. 3: Shape varieties of single spectrum hair color pen
Figure 4:
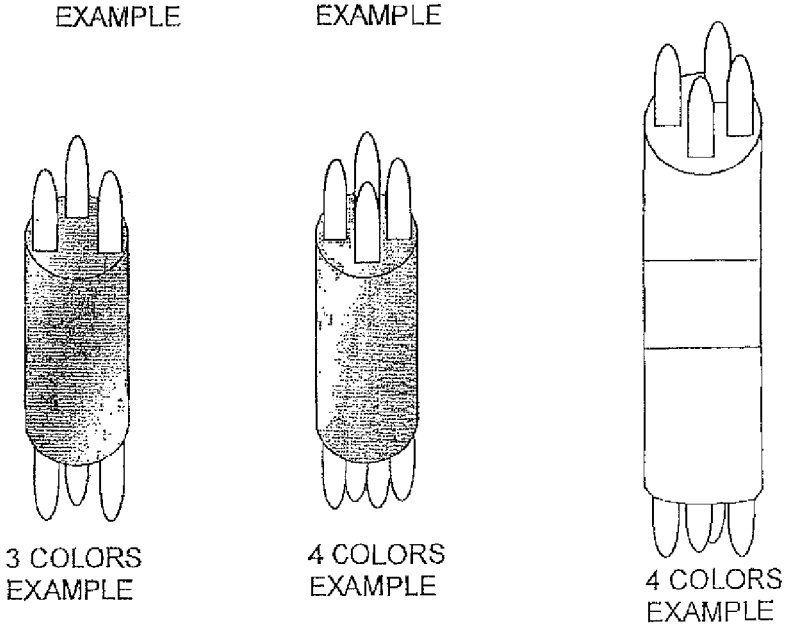
FIG. 4: Multiple spectrum hair color applicator designs

The invention may come in other various size and shapes as shown in FIG. 2 and FIG. 3. It is convenient to be carried in a clothing pocket or pocketbook based on the size selected by the user. The examples illustrated in FIG. 3 show several examples that include but are not limited to the invention's applicator shape. Also examples shown in FIG. 2 include but are not limited to the invention's amount of colors within each applicator.

The color and design of the applicator can be varied allowing for a version for men and for women making it unisex.

The formula for the compound used for the color that is applied to the gray and or white hair is:

Octyldodecanol
Aluminum Starch Octenylsuccinate
Euphorbia Cerifera (Candelilla) wax
Copemcia Cerifera (Camauba) wax
Caprylyl Glycol
Iron Oxides
Titanium Dioxide However, the color compound may vary but the basic characteristics remain the same and that being the coloring compound is firm, can be applied onto the gray to white hair easily by rubbing it on and can blend with the companion color or colors on the applicator to create a variety of color shades within a color scheme. The compound may vary in several ways that include but are not limited to the following: one can use it with or without the need to wet it and the compound can be odorless or have an odor.

Also, the formula can have ingredients added to it to allow for a hair treatment to include but not limited to adding a vitamin boost to fortify the hair or an herb extract that will enhance the strength of the hair root.

The invention provides an applicator that holds two or more hair color compounds. The applicator turns either manually or electronically exposing the color. The color can be applied without the need to wet it with water or used by wetting it with water. Once the person turns the applicator and the color compound comes out they can slide the color on to the gray or white hair simply and easily. The colors that are in one applicator are within a specific hair color family and can be blended together to make a variety of hair color shades by the user.

Since a person's hair changes colors (within a specific color range) from such unexpected circumstances which include but are not limited to exposure to the sun that has a tendency to lighten hair, from frequent use of chemicals that are applied to the hair such as hair treatments and last but not least by regular fading especially when the hair is dyed. The invention enables a person to use the color applicator with its varied colors that work together to create a desired color by the users since they can be blended.

The invention reduces the need for a person to constantly dye their hair to hide the gray and white hair. The invention gives a person more control over their looks and the tool to improve their appearance. The invention also is a great savings as it reduces the need for a person to spend money and time on constantly getting their hair dyed when they have those unwanted gray or white hairs showing periodically whether their hair color is natural or dyed.

In addition to the compound being able as a root touch up for gray and white hair which can be blended and act as a dye that washed out the compound also enables a person to create highlights to their hair. The formulation has the unique ability when applied to hair covers over any color hair whether it be darker or lighter than the shade being covered. Whereby the compound allows the hair of any color to be hidden and a new color drawn on top of it. The compound has the innovative properties that allow for example medium blonde color to go on top of a dark brown. Whereby hiding the dark brown color and showing only the medium brown in addition the compound has the ability to allow colors to be blended so in essence if a person took a light blonde color and a medium blonde they would create a third color that would be the combination of both colors that could be applied to any color darker or lighter and it would cover the color.

The compound allows for Instant Highlights™ to be placed in a persons hair themselves. When a person to applies the color which can be drawn on to any hair color without water that can create new hair colors for themselves instantly with no mess and no fuss. Not only can the invention enhance the look of a persons hair by adding highlights themselves, a person can also use the invention in various other ways. For example a person can use the invention to extend their own already dyed highlights by drawing over any hair growth. In addition a person could draw in a new look for the day or evening since the compound is temporary and can be washed out. Another way the invention can be used is test how highlights will look in ones hair since the compound washes out when shampooing.

The following includes but are not limited to the various features and benefits of the invention when used for highlighting the hair:

Create Highlights Without Using a Liquid Chemical. Create highlights with No Fuss No Mess Instantly By Drawing Them Into the Hair Temporary and Washes Out Saves a Person Time and Money By Not Having To Spend Hundreds of Dollars to Have Their Hair Highlighted Creates A Variety of Colors Instantly By Allowing A Person to Blend Them Together Themselves Portable Can Be Used Anywhere At Home, Work or On The Go No Need For Water or Mixing With Chemicals Instantly Creates High and Low Highlights in Minutes Ingredients list for some of the colors that can be made for the invention. The invention has a limitless amount of colors that can be created and the following list includes but is not limited to all of the possible ingredients that could be made for the invention

| BLACK | | |
|---|---|---|
| | Contains: | |
| 1 | DI-PPG MYRISTYL ETHER ADIPATE | 45.60 |
| 2 | OCTYLDODECANOL | 15.00 |
| 3 | ALUMINUM STARCH OCTENYLSUCCINATE | 8.00 |
| 4 | *EUPHORBIA CERIFERA* (CANDELILLA) WAX | 6.70 |
| 5 | *COPERNICIA CERIFERA* (CARNAUBA) WAX | 4.20 |
| 6 | CAPRYLYL GLYCOL | 0.50 |
| | May Contain | |
| 7 | IRON OXIDES (CI 7791, CI77492, CI77499) | 17.80 |
| 8 | TITANIUM DIOXIDE (CI 77891) | 2.20 |
| | | 100.00 |

| AUBURN | | |
|---|---|---|
| | Contains: | |
| 1 | DI-PPG MYRISTYL ETHER ADIPATE | 45.60 |
| 2 | OCTYLDODECANOL | 15.00 |
| 3 | ALUMINUM STARCH OCTENYLSUCCINATE | 8.00 |
| 4 | *EUPHORBIA CERIFERA* (CANDELILLA) WAX | 6.70 |
| 5 | *COPERNICIA CERIFERA* (CARNAUBA) WAX | 4.20 |
| 6 | CAPRYLYL GLYCOL | 0.50 |
| | May Contain | |
| 7 | IRON OXIDES (CI 7791, CI77492, CI77499) | 16.90 |
| 8 | TITANIUM DIOXIDE (CI 77891) | 3.10 |

| CARAMEL | | |
|---|---|---|
| | Contains: | |
| 1 | DI-PPG MYRISTYL ETHER ADIPATE | 45.60 |
| 2 | OCTYLDODECANOL | 15.00 |
| 3 | ALUMINUM STARCH OCTENYLSUCCINATE | 8.00 |
| 4 | *EUPHORBIA CERIFERA* (CANDELILLA) WAX | 6.70 |
| 5 | *COPERNICIA CERIFERA* (CARNAUBA) WAX | 4.20 |
| 6 | CAPRYLYL GLYCOL | 0.50 |
| | May Contain | |
| 7 | IRON OXIDES (CI 7791, CI77492, CI77499) | 5.80 |
| 8 | TITANIUM DIOXIDE (CI 77891) | 14.20 |
| | | 100.00 |

| DARK BROWN | | |
|---|---|---|
| | Contains: | |
| 1 | DI-PPG MYRISTYL ETHER ADIPATE | 45.60 |
| 2 | OCTYLDODECANOL | 15.00 |
| 3 | ALUMINUM STARCH OCTENYLSUCCINATE | 8.00 |
| 4 | *EUPHORBIA CERIFERA* (CANDELILLA) WAX | 6.70 |
| 5 | *COPERNICIA CERIFERA* (CARNAUBA) WAX | 4.20 |
| 6 | CAPRYLYL GLYCOL | 0.50 |
| | May Contain | |
| 7 | IRON OXIDES (CI 7791, CI77492, CI77499) | 20.00 |
| 8 | TITANIUM DIOXIDE (CI 77891) | |
| | | 100.00 |

-continued

| MEDIUM BROWN | | |
|---|---|---|
| | Contains: | |
| 1 | DI-PPG MYRISTYL ETHER ADIPATE | 45.60 |
| 2 | OCTYLDODECANOL | 15.00 |
| 3 | ALUMINUM STARCH OCTENYLSUCCINATE | 8.00 |
| 4 | *EUPHORBIA CERIFERA* (CANDELILLA) WAX | 6.70 |
| 5 | *COPERNICIA CERIFERA* (CARNAUBA) WAX | 4.20 |
| 6 | CAPRYLYL GLYCOL | 0.50 |
| | May Contain | |
| 7 | IRON OXIDES (CI 7791, CI77492, CI77499) | 6.90 |
| 8 | TITANIUM DIOXIDE (CI 77891) | 13.10 |
| | | 100.00 |

| LIGHT BLONDE | | |
|---|---|---|
| | Contains: | |
| 1 | DI-PPG MYRISTYL ETHER ADIPATE | 45.60 |
| 2 | OCTYLDODECANOL | 15.00 |
| 3 | ALUMINUM STARCH OCTENYLSUCCINATE | 8.00 |
| 4 | *EUPHORBIA CERIFERA* (CANDELILLA) WAX | 6.70 |
| 5 | *COPERNICIA CERIFERA* (CARNAUBA) WAX | 4.20 |
| 6 | CAPRYLYL GLYCOL | 0.50 |
| | May Contain | |
| 7 | IRON OXIDES (CI 7791, CI77492, CI77499) | 4.70 |
| 8 | TITANIUM DIOXIDE (CI 77891) | 15.30 |
| | | 100.00 |

I claim:

1. A hair coloration applicator comprising:

a single holder with two ends;

one opening provided at one of said ends and a corresponding opening provided at the other end;

a pair of hair coloration bar one of said pair of bars in the one opening and the other of said pair of bars in said corresponding opening;

both of the pair of hair coloration bars containing a coloring compound, both coloring compounds in the pair of hair coloration bars are in the same hair color family, the coloring compound in the one of said pair of hair coloration bars different in color than the coloring compound in the other of said pair of hair coloration bars, and the coloring compound in the one of said pair of hair coloration bars blend together with the color compound in the other of said pair of hair coloration bars make a variety of hair color shades.

2. The hair coloration applicator of claim 1, where said holder is cylindrical.

3. The hair coloration applicator of claim 1, where said holder is a regular polyhedron.

4. The hair coloration applicator of claim 1, where said holder has an hourglass shape.

5. The hair coloration applicator of claim 1, where multiple openings are provided on each of said ends.

6. The hair coloration applicator of claim 5, where multiple pair of coloration bars are fixed in said openings corresponding to each other.

7. The hair coloration applicator of claim 1, where the hair color family are chosen from a member of a group consisting of black-dark brown, dark brown-middle brown, auburn-middle brown and light blonde brown-middle brown.

8. A system for coloring hair comprising:

coloring hair with one color using one of a pair of coloration bars of the applicator of claim 1 to provide colored hair; and coloring the colored hair with a second color using another of the pair of coloration bars of the applicator of claim 1 to blend the colors.

9. A system for highlighting hair comprising:

highlighting hair with one color using one of a pair of coloration bars of the applicator of claim 1; and highlighting hair with a second color using another of the pair of coloration bars of the applicator of claim 1.

* * * * *